US006017201A

United States Patent [19]

Yang

[11] Patent Number: 6,017,201

[45] Date of Patent: Jan. 25, 2000

[54] AIR PUMP WITH A HIDDEN EXTENSION TUBE

[76] Inventor: Hsi-Kung Yang, No.24, Lane 65, San Chun St., Shu Lin Chen, Taipei Hsien, Taiwan

[21] Appl. No.: 09/118,562

[22] Filed: Jul. 17, 1998

[51] Int. Cl.[7] ..... F04B 39/00

[52] U.S. Cl. ..... 417/454; 417/553; 417/572

[58] Field of Search ..... 417/553, 454, 417/238, 572

[56] References Cited

U.S. PATENT DOCUMENTS

| | | | |
|---|---|---|---|
| 5,338,166 | 8/1994 | Schultz | 417/442 |
| 5,476,372 | 12/1995 | Yang | 417/553 |
| 5,655,890 | 8/1997 | Liao | 417/234 |

*Primary Examiner*—Henry Bennett
*Assistant Examiner*—Malik N. Drake
*Attorney, Agent, or Firm*—Kolisch Hartwell Dickinson McCormack & Heuser

[57] ABSTRACT

An air pump is provided with an outer tube, a piston sealingly and slidably movable in the outer tube, an operating rod securely engaged with the piston and slidably received within the outer tube, a plug securely inserted into one end of the outer tube and allowing the operating rod to be slidably extending therethrough and an extension tube extending out from the other end of the outer tube. The operating rod has a channel adapted to slidably receive the extension tube therein. Therefore, when the extension tube is not in use, the extension tube is able to be received within the channel of the operating rod and the extension tube is able to be drawn out from the operating rod when in use to inflate a inflatable product.

12 Claims, 6 Drawing Sheets

AIR PUMP WITH A HIDDEN EXTENSION TUBE

BACKGROUND OF THE INVENTION

1. Field of the invention

The present invention relates to an air pump, and more particularly to an air pump with a hidden extension tube received therein for facilitating the operation and transportation of the air pump.

2. Background

A conventional air pump is shown in U.S. Pat. No. 5,681,154. The patent shows that an air pump with dual air intakes is able to draw in and discharge air by means of each stroke of the piston slidably received within the air pump, which is really an improvement when compared with a conventional model. However, because of the limitation of the structure, a user will have to adjust himself or the air pump in order to correspond to different angles of the inlet provided on a variety of products when the air pump is applied to inflate an inflatable product. To avoid the necessity of adapting to different angles of the air pump, an extension tube made of elastic material is provided with the air pump, such that the user is able to readily inflate an object without adjusting or adapting to different angles of the inlets of the products. Still, the air pump with an extension tube causes a transportation problem. Because the extension tube is added to the air pump and exposed to the air, the user will have trouble carrying the air pump with the extension tube easily. Although the extension tube is detachably connected to the air pump and the user is able to detach the extension tube from the air pump so as to facilitate Transportation thereof, the user will still have to use positioning elements, such as rubber band, to securely hold the extension tube to the air pump, which often troubles the users.

The present invention provides an improved air pump with a hidden extension tube to obviate and/or mitigate the aforementioned problems. The air pump of the invention has a channel defined for slidably receiving the extension tube therein, such that the extension tube is able to be received within the channel when not in use, and the extension tube is able to be drawn out of the channel when in use.

SUMMARY OF THE INVENTION

The primary object of the invention is to provide an improved air pump having an extension tube slidably received in a channel defined in an operating rod of the air pump. The air pump is provided with an outer tube, a piston sealingly and slidably movable in the outer tube, an operating rod securely engaged with the piston and slidably received within the outer tube, a plug securely inserted into one end of the outer tube and allowing the operating rod to be slidably extending therethrough and an extension tube extending out from the other end of the outer tube. The operating rod has a channel adapted to slidably receive the extension tube therein. Therefore, when the extension tube is not in use, the extension tube is able to be received within the channel of the operating rod and the extension tube is able to be drawn out from the operating rod when in use to inflate a inflatable product.

Other novel features and advantages of the invention will become more apparent from the following detailed description when taken in conjunction with the accompanying drawings.

DETAILED DESCRIPTION OF THE PREFERRED EMBODIMENT

Figure 1:
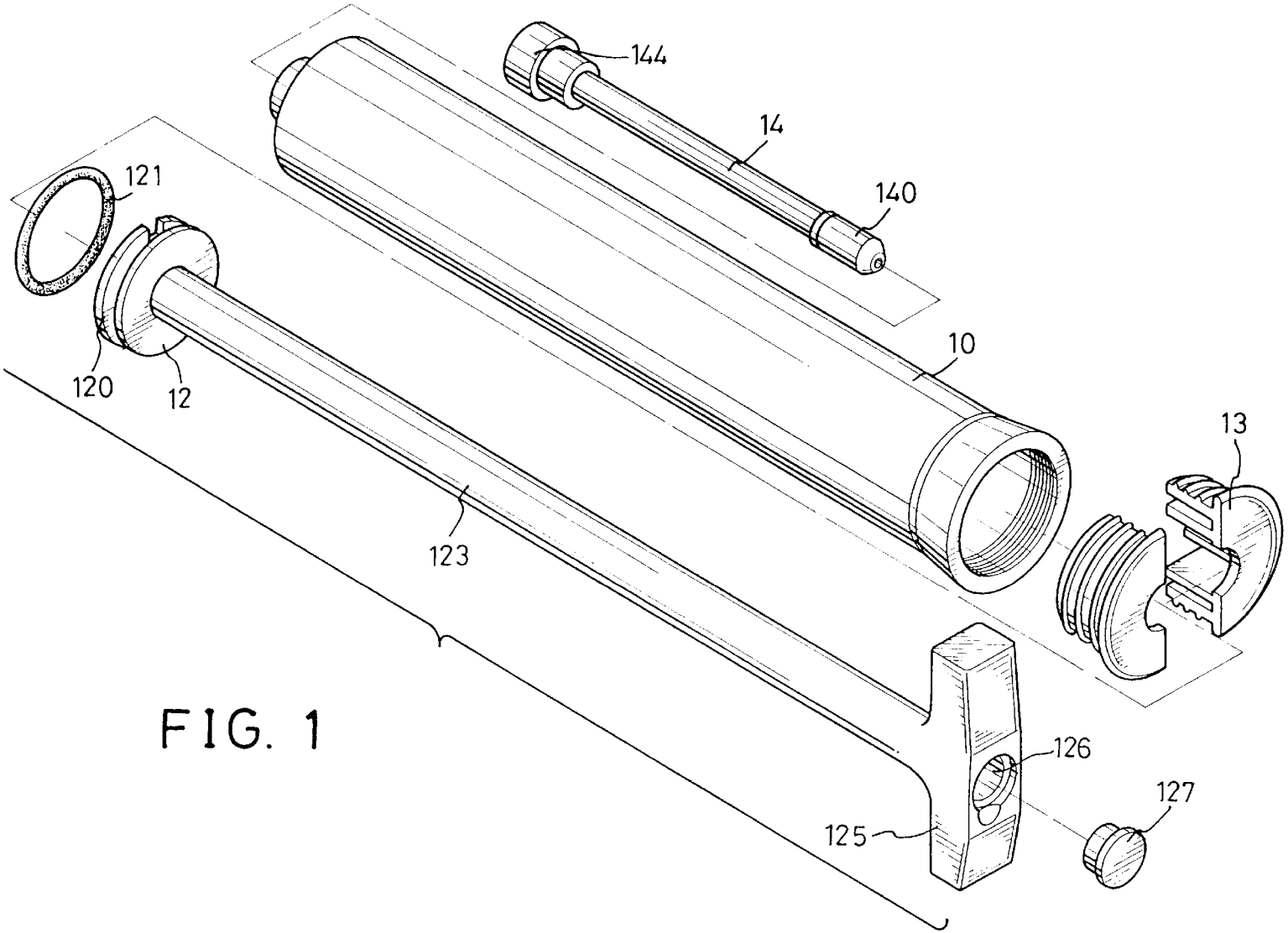
FIG. 1 is an exploded view of a preferred embodiment of an air pump of the invention.
Figure 2:
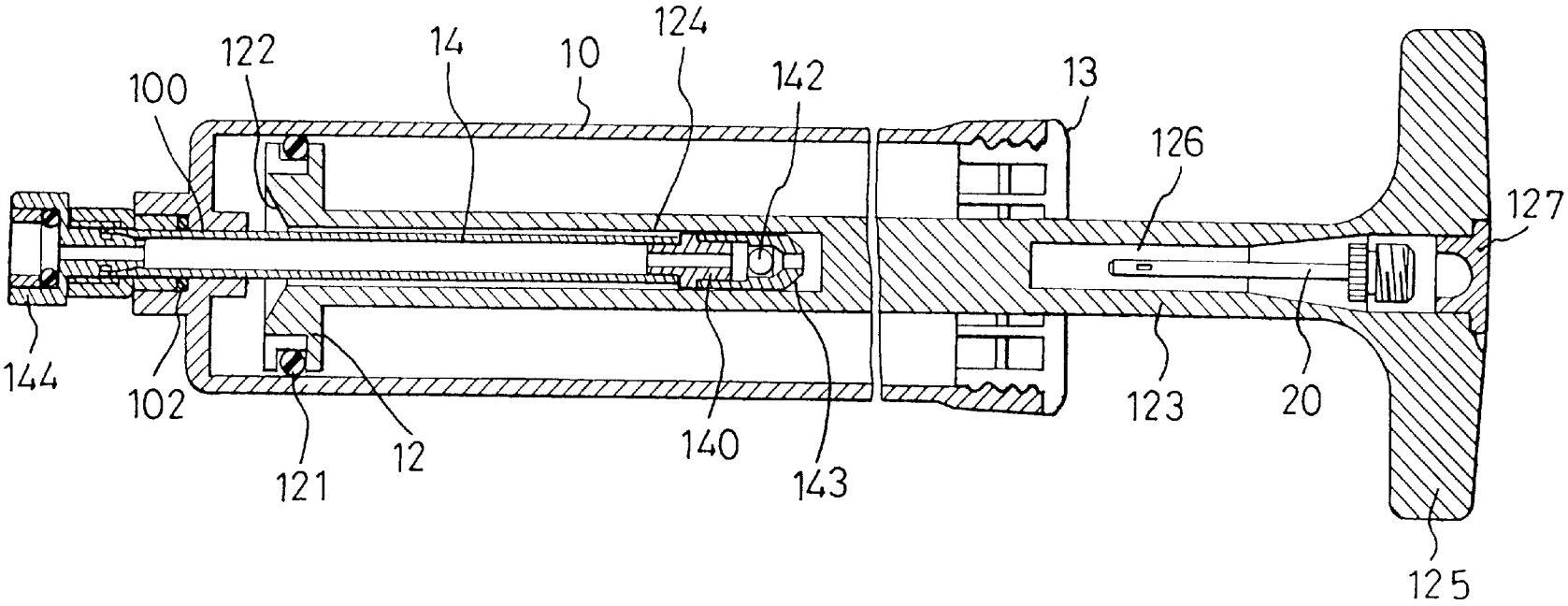
FIG. 2 shows a cross sectional view of the air pump of FIG. 1 in assembly.
Figure 3:
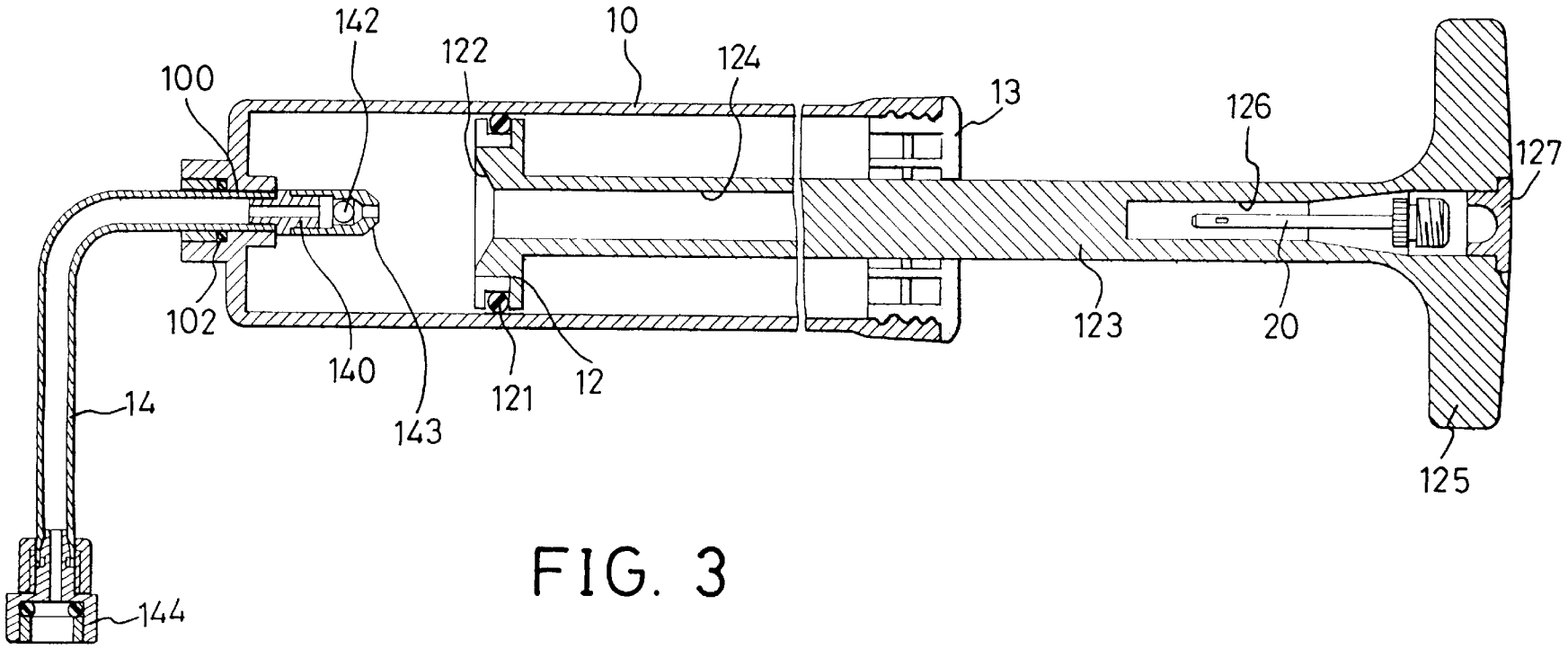
FIG. 3 is a schematically cross sectional view showing the operation of the air pump shown in FIG. 1.

Referring to FIGS. 1 and 2, an improved air pump comprises an outer tube (10), a piston (12) slidably and sealingly received within the outer tube (10), a plug (13) securely inserted into the outer tube (10) for blocking one end of the outer tube (10), an operating rod (123) securely engaged with the piston (12) and slidably received within the outer tube (10) and extending out from the plug (13) and an extension tube (14) slidably received within the operating rod (123) and selectively extending out from the other end of the outer tube (10). It is to be noted that the piston (12) has a groove (120) defined for receiving therein a sealing (121), such that the piston (12) is able to be sealingly engaged with an inner periphery of the outer tube (10) when driven by the operating rod (123). The operating rod (123) defines therein a channel (124) and has a handle (125) integrally formed therewith, a chamber (126) defined in the handle (125) for receiving therein a spare part, such as a needle (20), and a cap (127) for blocking the chamber (126) when necessary. The outer tube (10) has an outlet (100) defined in a first end thereof and an annular ring (102) sealingly mounted around a periphery defining the outlet (100). The extension tube (14), as previously stated being slidably received in the channel (124) of the operating rod (123), has a first end (140) with a diameter greater than that of the pipe (14) and a second end (144) with a diameter still greater than the diameter of the first end (140). It is to be noted from FIG. 2 that the outlet (100) of the outer tube (10) has a first diameter corresponding to a diameter of the extension tube (14) so as to prevent the first end (140) from falling out of the outer tube (10) and a second diameter smaller than the diameter of the second end (144) so as to prevent the second end (144) of the extension tube (14) from entering the outer tube (10). The operating rod (123) has a cone-shaped recess (122) defined to communicate with the channel (124) and correspond to a conical end face (143) of the extension tube (14), such that the insertion of the conical end face (143) of the extension tube (14) into the channel (124) of the operating rod (123) is enhanced. Furthermore, a check valve (142) is provided in the extension tube (14) to ensure the direction of the air flow is limited. Comparing the configuration of FIG. 2 and FIG. 3, it is noted that the extension tube (14) is able to be received within the channel (124) of the operating rod (123) when not in use, however, the extension tube (14) is able to be drawn out from the channel (124) and extended out from the outlet (100) when in use.

Figure 4:
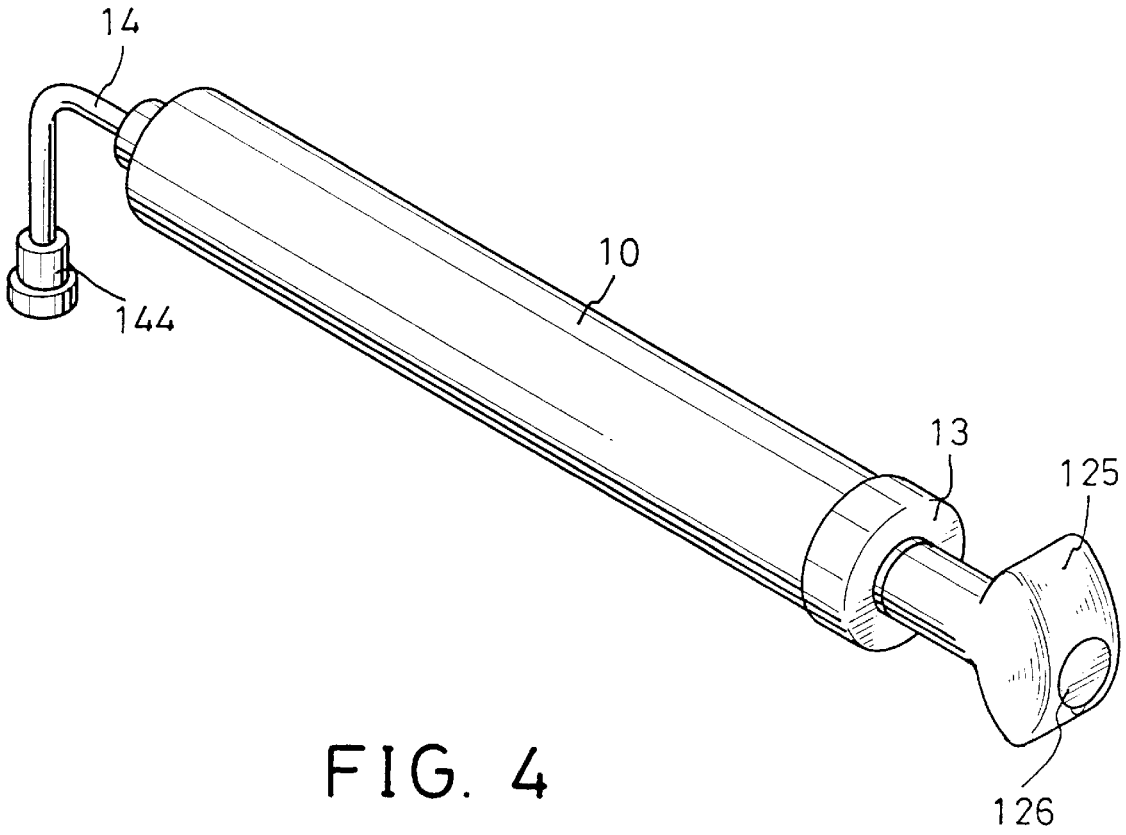
FIG. 4 is a schematically perspective view of another preferred embodiment of the invention.
Figure 5:
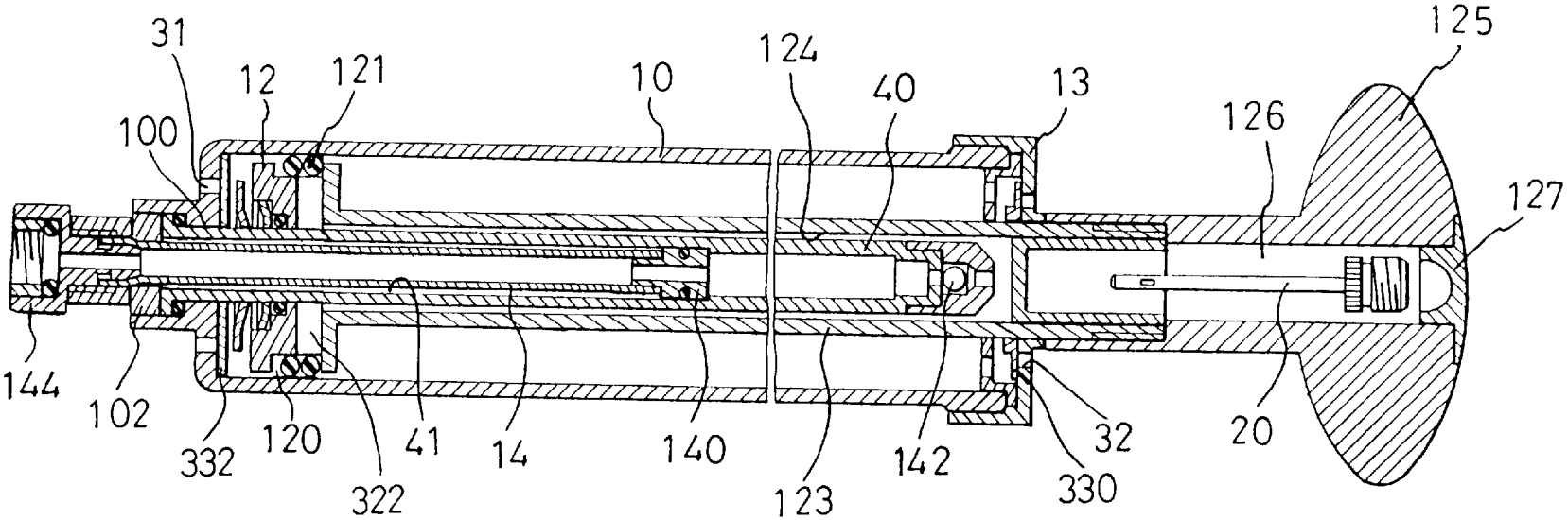
FIG. 5 is a cross sectional view of the air pump shown in FIG. 4 in assembly.
Figure 6:
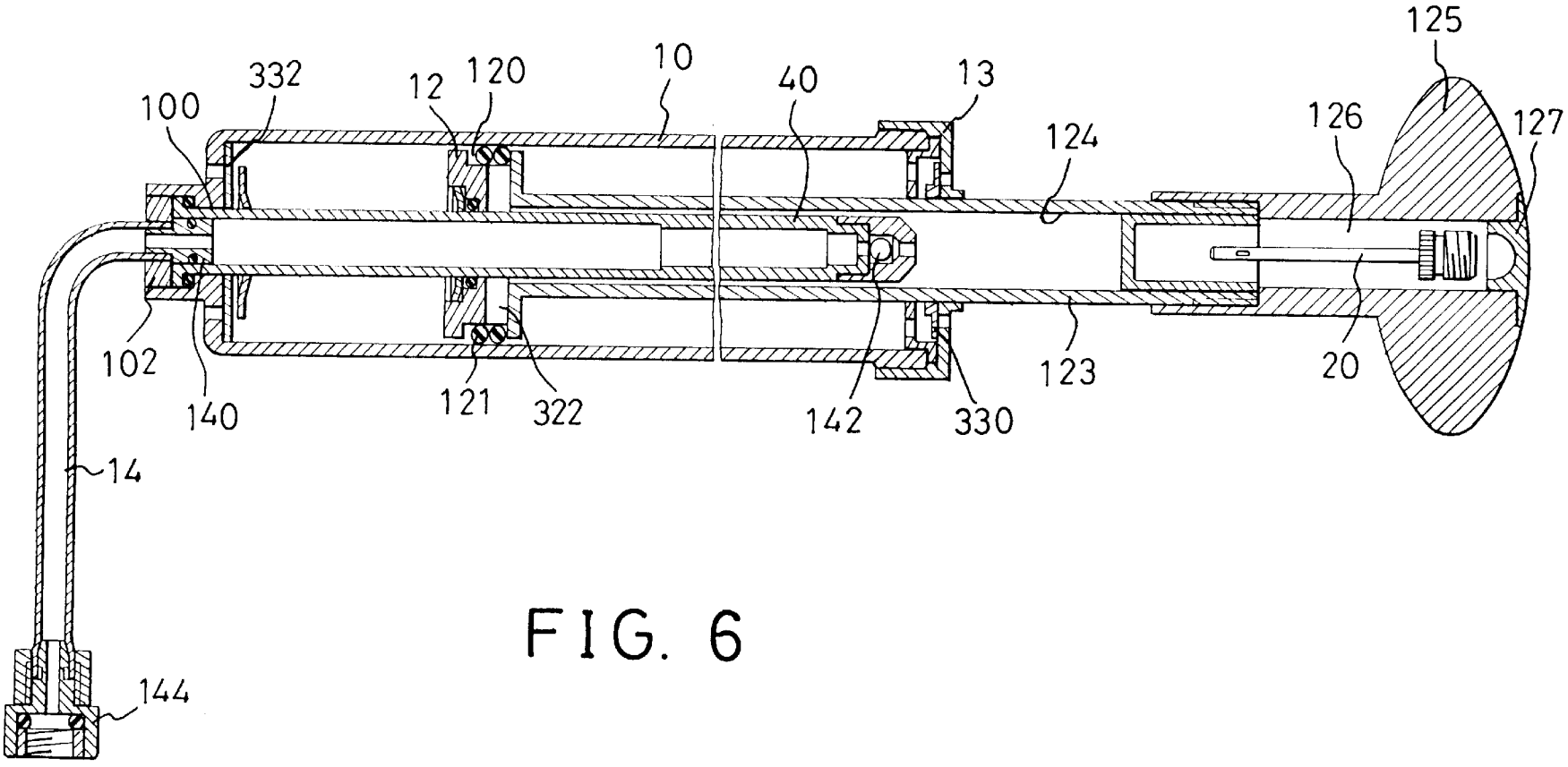
FIG. 6 is a schematically cross sectional view showing the operation of the air pump shown in FIG. 4.

Referring to FIG. 4, 5 and 6, an air pump with dual air intakes of the applicant's patent (U.S. Pat. No. 5,681,154) is shown. Similar elements shown in this patent are designated the same reference numerals so that a comparison between the configuration of the patent and the air pump shown in FIG. 1 is seen. The object of this patent is to provide an air pump capable of providing dual air intakes in which diaphragms (330), (332) and multiple air inlets (31), (32) are provided at either end of the pump body and, by means of the motion of the operation rod (123), each stroke will drawn in air and discharge air. Besides the provision of the diaphragms (330), (332) and the air inlets (31), (32), a major difference between the air pump shown in FIG. 1 and the Patent is that the patent has an inner tube (40) securely received within the outer tube (10). As discussed earlier, the operation rod (123) has a channel (124) for receiving therein the inner tube (40). The inner tube (40) has a duct (41) defined for slidably receiving therein the extension tube (14). The first end (140) of the extension tube (14) has a diameter greater than that of the extension tube (14) and a second end (144) with a diameter still greater than the diameter of the first end (140). It is to be noted that the outlet (100) of the outer tube (10) has a first diameter corresponding to a diameter of the extension tube (14) so as to prevent the first end (140) of the extension tube (14) from falling out of the outer tube (10) and a second diameter smaller than the diameter of the second end (144) so as to prevent the second end (144) of the extension tube (14) from entering the outer tube (10). Because most elements and the operation thereof in the patent are conventional and thus detailed description thereof is not necessary.

From the foregoing description, it is noted that the invention has the following advantages:

1. easy operation;
2. easy to carry around; and
3. simple in structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air pump with a hidden extension tube comprising: an outer tube, a piston slidably and sealingly received within the outer tube, a plug securely inserted into the outer tube for blocking one end of the outer tube and an operating rod securely engaged with the piston and slidably received within the outer tube and extending out from the plug, wherein the improvements are:

an extension tube is slidably received within the operating rod and selectively extending out from one end of the outer tube.

2. The air pump as claimed in claim 1, wherein the operation rod has a channel defined to slidably receiving the extension tube therein.

3. The air pump as claimed in claim 2, wherein the extension tube has a first end with a diameter the same as a diameter of the channel.

4. The air pump as claimed in claim 1, wherein an end face of the first end of the extension tube is conical.

5. The air pump as claimed in claim 1, wherein the outer tube has an outlet with a first diameter smaller than the diameter of the first end of the extension tube, whereby the first end of the extension tube is prevented from falling out from the outer tube.

6. The air pump as claimed in claim 5, wherein the outlet of the outer tube has a second diameter smaller than a diameter of a second end of the extension tube, whereby the second end of the extension tube is prevented from entering the outer pipe.

7. An air pump comprising:

means for air intake and discharge; and an extension tube selectively and slidably received within the means.

8. The air pump as claimed in claim 7, wherein means for air intake and discharge comprising an outer tube, a piston slidably and sealingly received within the outer tube, a plug securely inserted into the outer tube for blocking one end of the outer tube, an operating rod securely engaged with the piston and slidably received within the outer tube and extending out from the plug, and an inner tube securely received within the outer tube and slidably received within the operating rod.

9. The air pump as claimed in claim 8, wherein the inner tube has a channel defined to receive the inner tube therein.

10. The air pump as claimed in claim 9, wherein the extension tube has a first end with a diameter the same as a diameter of the channel.

11. The air pump as claimed in claim 8, wherein the outer tube has an outlet with a first diameter smaller than the diameter of the first end of the extension tube, whereby the first end of the extension tube is prevented from falling out from the outer tube.

12. The air pump as claimed in claim 8, wherein the outlet of the outer tube has a second diameter smaller than a diameter of a second end of the extension tube, whereby the second end of the extension tube is prevented from entering the outer pipe.

* * * * *